US008286968B2

(12) United States Patent
Duerr

(10) Patent No.: US 8,286,968 B2
(45) **Date of Patent: *Oct. 16, 2012**

(54) ADJUSTABLE PROJECTILE TARGET

(76) Inventor: Greg Duerr, Appleton, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/098,766

(22) Filed: May 2, 2011

(65) Prior Publication Data

US 2011/0204571 A1 Aug. 25, 2011

Related U.S. Application Data

(63) Continuation of application No. 12/472,829, filed on May 27, 2009, now Pat. No. 7,946,589.

(60) Provisional application No. 61/056,187, filed on May 27, 2008.

(51) Int. Cl.
*F41J 1/10* (2006.01)

(52) U.S. Cl. ..... 273/407; 273/408; 273/390

(58) Field of Classification Search ..... 273/398–410, 273/390–392, 378, 386, 387
See application file for complete search history.

(56) References Cited

U.S. PATENT DOCUMENTS

| | | | | | |
|---|---|---|---|---|---|
| 1,525,339 | A * | 2/1925 | Toohey | 273/407 |
| 3,034,788 | A * | 5/1962 | Cauble | 273/408 |
| 3,087,701 | A * | 4/1963 | Wallace | 248/166 |
| 3,586,331 | A * | 6/1971 | Tickell, Jr. | 273/359 |
| 4,029,318 | A * | 6/1977 | Boss | 273/390 |
| 4,546,984 | A * | 10/1985 | Towle et al. | 273/404 |
| 4,813,684 | A * | 3/1989 | Bruno | 273/403 |
| 5,584,480 | A * | 12/1996 | Grimsrud | 473/416 |
| 5,676,378 | A * | 10/1997 | West | 273/390 |
| 5,816,579 | A * | 10/1998 | Broussard et al. | 273/408 |
| 5,906,552 | A * | 5/1999 | Padilla | 473/421 |
| 5,928,087 | A * | 7/1999 | Emberton et al. | 473/245 |
| 6,379,272 | B1 * | 4/2002 | Gorgo et al. | 473/421 |
| 7,497,441 | B2 * | 3/2009 | Marshall et al. | 273/391 |
| 7,946,589 | B2 * | 5/2011 | Duerr | 273/407 |
| 2009/0014961 | A1 * | 1/2009 | Bateman et al. | 273/407 |

* cited by examiner

*Primary Examiner* — Mark Graham
(74) *Attorney, Agent, or Firm* — Boyle Fredrickson S.C.

(57) ABSTRACT

The present invention is an adjustable projectile target that includes a support structure that can hold a body portion of the target at various angular positions with regard to the support structure. The support structure allows the body portion to be rotated along both a vertical and a horizontal axis to provide a variety of target profiles for the body portion to simulate for the individual shots taken from various elevations and distances from the target animal.

13 Claims, 4 Drawing Sheets

ADJUSTABLE PROJECTILE TARGET

CROSS-REFERENCE TO RELATED APPLICATIONS

This application claims priority 35 U.S.C. §120 as a continuation of U.S. Non-Provisional Application Ser. No. 12/472,829, filed May 27, 2009, which in turn claims priority under 35 U.S.C. §119(e) from U.S. Provisional Patent Application Ser. No. 61/056,187, filed on May 27, 2008, the entirety of which are each expressly incorporated by reference herein.

FIELD OF THE INVENTION

This invention relates to targets for practicing the firing of a projectile, and more specifically to targets that provide a more realistic shooting profile to an individual.

BACKGROUND OF THE INVENTION

With regard to targets, there are many different types of targets that have been previously developed to give individuals the ability to practice effectively striking a target with a projectile, such as a bullet or an arrow. These targets come in various shapes and sizes, with many targets having the shape of the different animals that are going to be hunted by the archer. These targets can also be configured to move in the nature of the actual animal being hunted, and can be formed from a number of different materials to give a more realistic structure to the actual target, which in each case presents a more realistic target to the hunter.

However, these prior art targets, while providing a more than adequate structure for approximating the size and shape of the particular animal, have a significant shortcoming concerning the position or profile they present when used as a target. In particular, the prior art targets are each mounted to a structure that holds the target in a generally upright position, such that the target is perpendicular to the ground. This position is acceptable when the hunter expects to be shooting only horizontally at the target. However, in many situations the hunter is located in an elevated position with regard to the animal, such as in a tree stand, so the animal does not present a full profile to the hunter. But when practicing, often times the individual is not in the elevated position and is shooting horizontally at the target. Thus, a target mounted to only present a horizontal full side profile to the hunter does not provide an accurate representation of the target at which the hunter is shooting when in an elevated position.

Therefore, it is desirable to develop a target that is mounted to a support in a manner that enables the target to be moved into different angular positions with regard to the support. By moving to these positions, the target can present a realistic profile to a hunter shooting horizontally at the target to approximate the animal profile seen when shooting from an elevated location.

SUMMARY OF THE INVENTION

According to one aspect of the present invention, a target is provided that includes a target body mounted to a base structure. The target body can be formed in a conventional manner and/or of conventional materials, and can have any desired shape. The target body is secured to an upright member that extends outwardly from the target body. Opposite the target body, the upright member is pivotally secured to a support member that can rest on the ground or other surface to support the target body. Due to the pivotal connection of the upright member to the support member, the target body can be angularly adjusted relative to the support member to provide a reduced profile that is more representative of the actual animal profile seen by a hunter located in an elevated hunting position, such as in a tree stand.

According to still another aspect of the present invention, the support member and the upright member include indicia illustrating the proper position of the upright member relative to the support member to provide an animal profile for a specified elevation and distance for the individual from the animal.

Numerous other aspects, features and advantages of the invention will be made apparent from the following detailed description taken together with the drawing figures.

BRIEF DESCRIPTION OF THE DRAWINGS

The drawing figures illustrate the best mode currently contemplated of performing the present invention.

In the drawings.

DETAILED DESCRIPTION OF THE INVENTION

Figure 1:
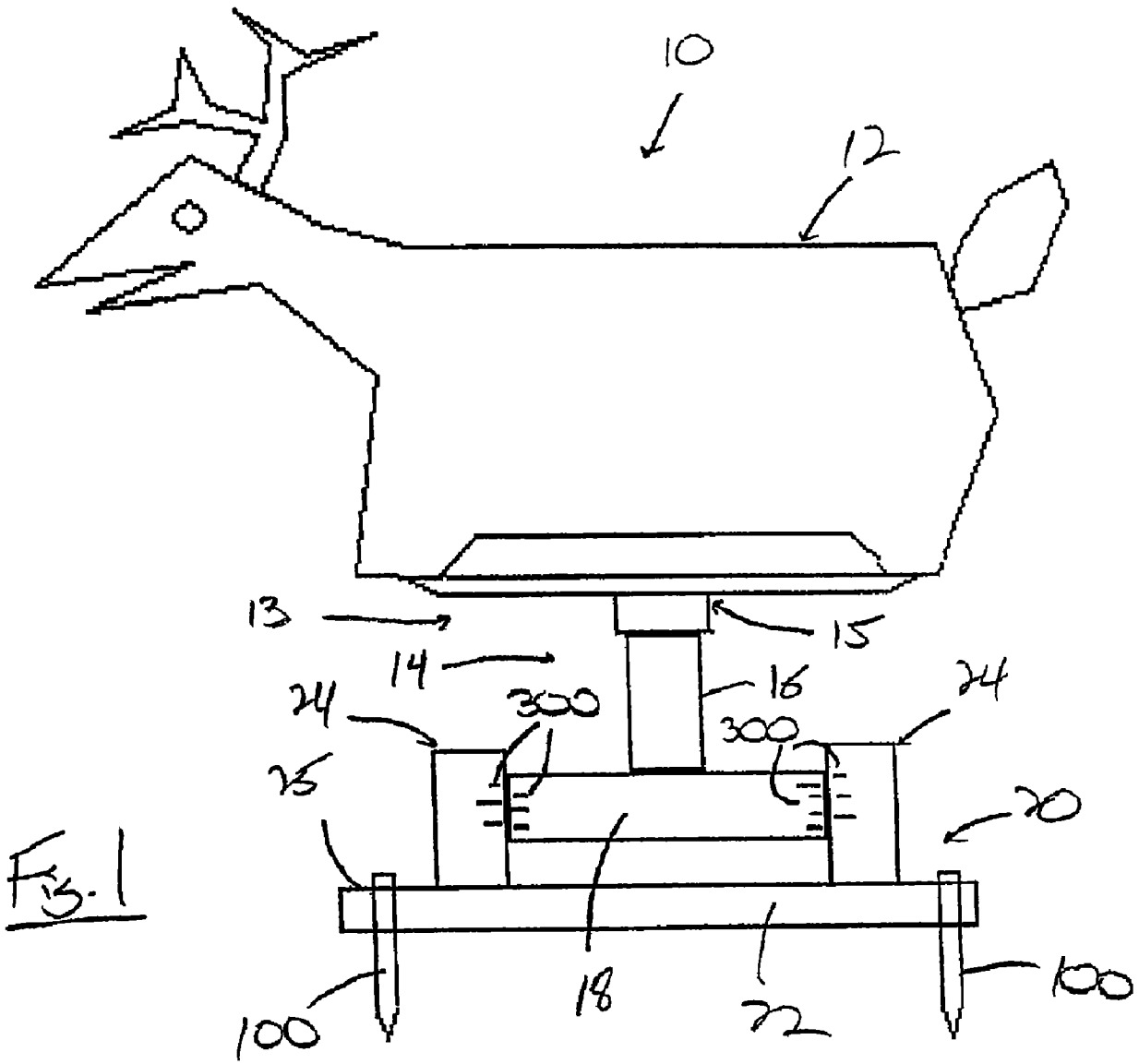
FIG. 1 is an isometric view of a target constructed according to the present invention in an upright position.
Figure 2:
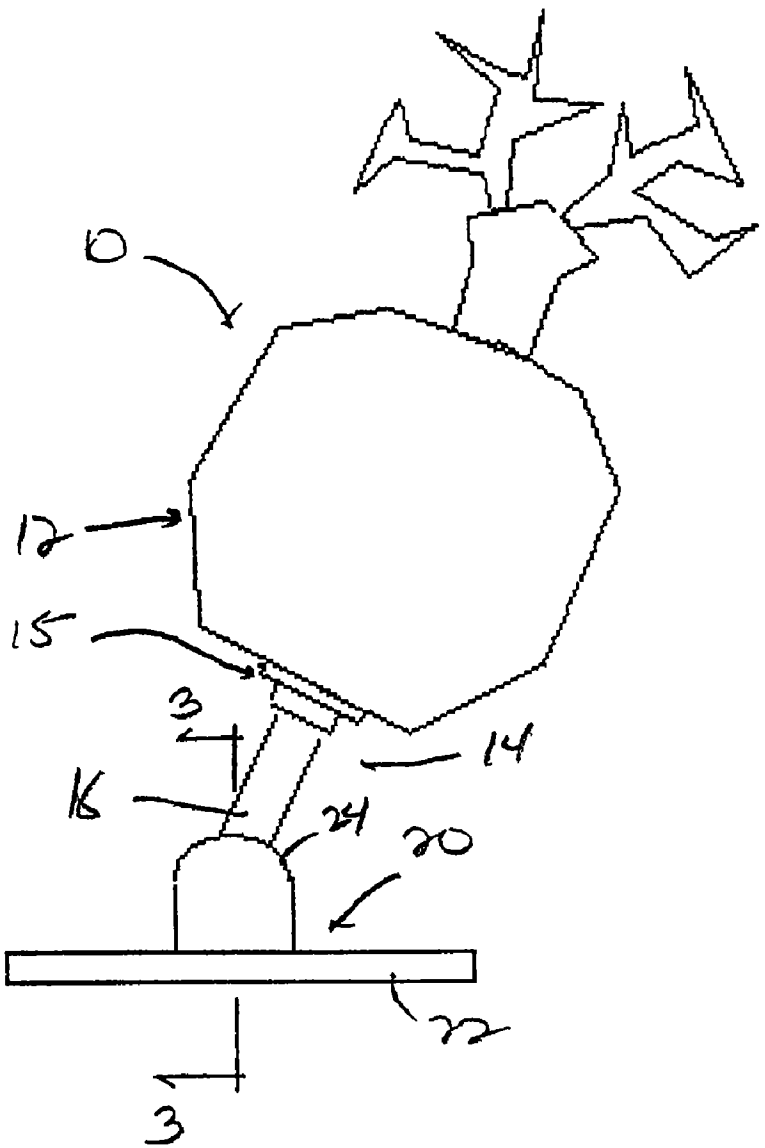
FIG. 2 is a rear plan view of the body of the target of FIG. 1 in an angled position with regard to the support member.
Figure 3:
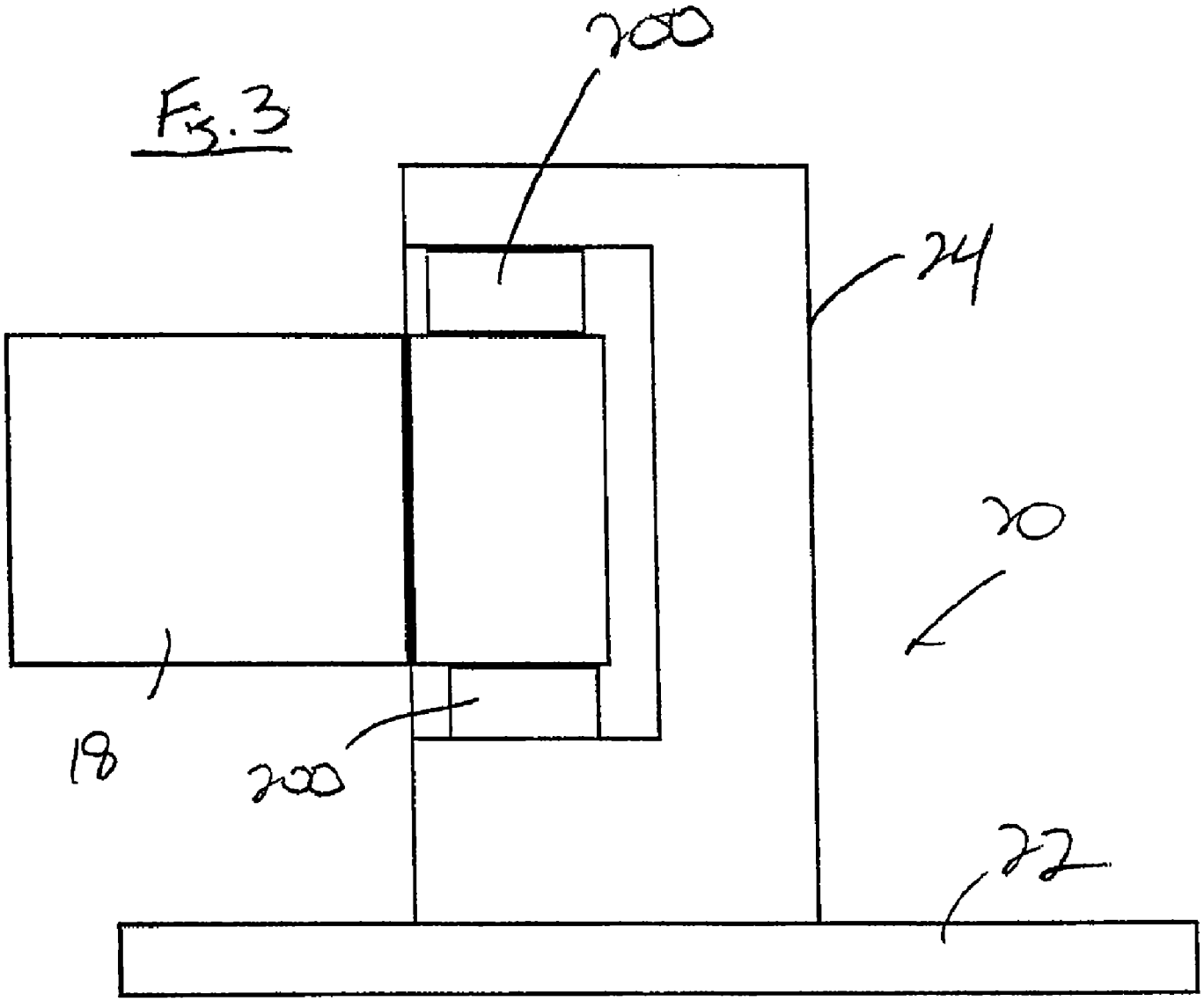
FIG. 3 is a partially broken away cross-sectional view along line 3-3 of FIG. 2.

With reference now to the drawing figures in which like reference numerals designate like parts throughout the disclosure, a target constructed according to the present invention is illustrated generally at 10 in FIG. 1. The target 10 includes a body portion 12 secured to a support means 13. The body portion 12 can take the shape of any desired animal or portion thereof to be hunted by an individual, or any other desired shape. The body portion 12 can also be formed of any suitable material, such as various molded foam materials, ballistics gels, or plastic materials, among others. The body portion 12 can also have any desired internal structure (not shown) to support the material forming the body portion 12, such as a wire mesh or tubular members disposed within the body portion 12, or any other internal or external features designed to assist the individual utilizing the target 10, e.g., in determining the accuracy or other parameters of the shots being fired at the target 10 or moving the target 10.

The body portion 12 is affixed to one end of an upright member 14 of the support means 13, such as by connecting the upright member 14 to the internal structure of the body portion 12, or molding the material forming the body portion 12 around one end of the upright member 14. Additionally, the internal structure of the body portion 12 can extend outwardly from the body portion 12 to be engaged with the upright member 14 in a manner that allows the body portion 12 to be rotated along a generally vertical axis about the upright member 14. In a preferred embodiment, the internal structure includes a portion 15 insertable onto or into the upright member 14 and rotatable with respect thereto.

To enable the upright member 14 to support the body portion 12, the upright member 14 is preferably formed of a generally rigid material, such as a metal or hard plastic, that can have any desired shape sufficient to engage and securely hold the body portion 12, and also sufficient to withstand a strike from an arrow (not shown) or other projectile that may strike the upright member 14.

The upright portion 14, in a preferred embodiment, is formed from a vertical member 16 that is affixed to the body portion 12, and a horizontal member 18 secured to the vertical member 16, such as by welding, to form a T-shaped upright member 14. More preferably, the vertical member 16 and the horizontal member 18 are each formed from a tubular structure, most preferably having a circular cross-section, and formed from a metal, such as aluminum or steel.

Opposite the body portion 12, the upright member 14 is secured to a support member 20. The support member 20 includes a base member 22 and a pair of opposed sockets 24 spaced from one another and secured to the base member 22, such as by welding or by using a suitable fastener or adhesive. Preferably the sockets 24 are disposed at or adjacent to the opposite ends of the base member 22, which is formed of a metal, such that the sockets 24, also preferably formed of a metal, can be welded thereto. Alternatively, the base member 22 and the sockets 24 can be formed from materials such as various metals or plastics that enable the base member 22 and sockets 24 to be integrally formed with one another in a suitable molding process.

The base member 22 can be formed in any suitable manner to provide a point of attachment for the upright member 14 and the body portion 12 to a stable base to maintain the target 10 in a desired position when in use. The base member 22 can be formed to function as the stable base itself, or can be configured to be secured to any other structure or surface, such as by welding or using any suitable fasteners, including stakes 100 that can be driven through openings 25 in the base member 22 to affix the base member 22 to the ground.

The sockets 24 are formed to have an interior cross-section that is complementary to the shape of the horizontal member 18 of the upright member 14, such that the ends of the horizontal member 14 can be inserted into the sockets 24 and rotated therein along a generally horizontal axis. Within each of the sockets 24 is disposed a suitable frictional member 200 that operates to restrict the rotation of the horizontal member 18 with respect to each of the sockets 24 such that the horizontal portion 18, and consequently the body portion 12 secured thereto, can be maintained in the desired angular position to present a profile of the body portion 12 corresponding to the likely elevation and distance between the hunter and the animal. The frictional member 200 is formed o any suitable material that can securely frictionally engage the horizontal member 18 to hold the horizontal member 18 stationary within the socket 24, while also allowing the member 18 to be rotated when a sufficient force is applied to the member 18.

Additionally, to assist the frictional member 200 in holding the body portion 12 in the desired angular position relative to the support member 20, a suitable locking device 400 is disposed on one the upright member 14 or the support member 20 and is capable of securely, but releasably, engaging the other of the upright member 14 or the support member 20 to maintain the position of the members 14 and 20 relative to one another when struck by a projectile. Examples of these types of devices include ratchet mechanisms, locking pins, which can be spring-biased, locking clips and tabs, among other suitable devices. In an alternative embodiment, the member 200 can alternatively be formed to be a bearing member, with the locking device 400 solely providing the function of holding the upright member 14 and support member 20 stationary with regard to one another.

Figure 4:
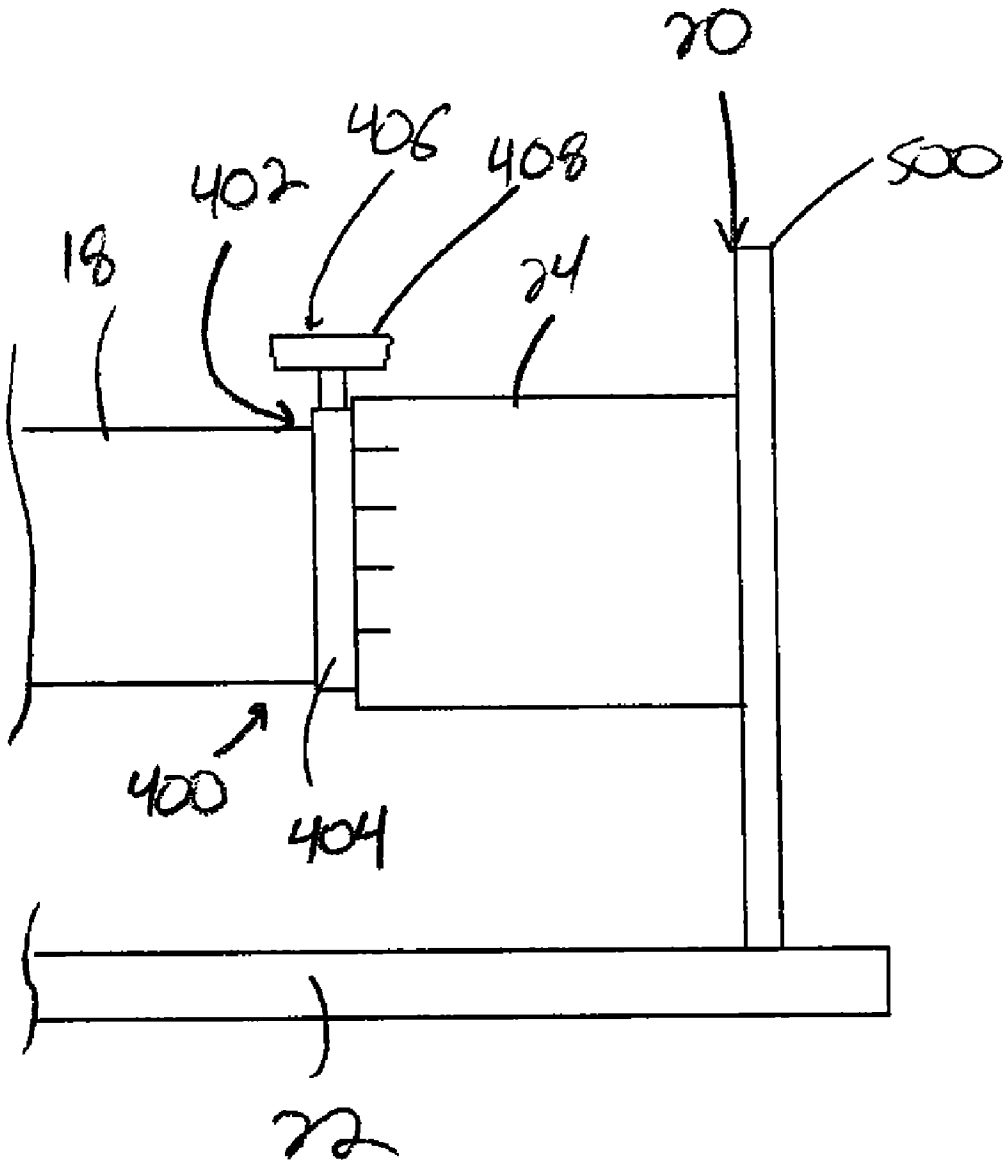
FIG. 4 is a partially broken away cross-sectional view similar to FIG. 3 of a second embodiment of the target of FIG. 1.

In another embodiment of the invention, as best shown in FIG. 4, the horizontal portion 18 of the upright member 14 is connected to the support member 20 by being inserted within the socket 24 that is formed of a tubular member that is secured to an upright bracket 500 connected to the base member 22 generally opposite the socket 24. The upright bracket 500 is affixed to the socket 24 and the base member 22 in any suitable manner, such as by using mechanical fasteners or by welding or adhering the pieces together. In a preferred structure, the upright bracket 500 is made of a metal that enables the bracket 500 to be welded to the socket 24 and base member 22.

To hold the upright member 14 at the desired angle with respect to the socket 24, a locking device 400 in the form of a hose clamp 402 is secured around the horizontal portion 18 of the upright member 14 and connected to the socket 24 in a suitable manner. The clamp 402 is formed with a band 404 of a suitable material disposed around the horizontal member 18 and connected at each end to a securing mechanism 406. The mechanism 406 has a handle 408 that allows the device 406 to be tightened and loosened, in order to tighten and loosen the band 404 around the horizontal member 18 in a known manner, thereby enabling or disabling the ability of the horizontal member 18 to rotate with respect to the socket 24.

To allow the hunter to put the body portion 12 in the desired position, the sockets 24 and/or the horizontal portion 18 can have indicia 300 printed thereon which provides the hunter with the proper position of the horizontal portion 18 for a shot at a specified height for the hunter and a specified distance between the animal and the hunter. In addition, due to the ability of the body portion 12 to rotate along the longitudinal axis of the vertical member 16, the body portion 12 can also be positioned to allow the hunter to simulate a shot of the animal walking directly towards the hunter, directly away from the hunter, or at any angle therebetween.

Various alternatives are contemplated as being within the scope of the following claims, which particularly point out and distinctly claim the subject matter regarded as the present invention.

I claim:

1. A projectile target comprising:

a) a body portion; and b) a support means including a first member secured directly to the body portion and a second member rotatably affixed directly to the first member opposite the body portion and able to hold the first member at a desired angular position with regard to the second member, wherein the body portion is rotatably secured to the first member opposite the second member, further comprising a locking device disposed on one of the first member or the second member and releasably engageable with the other of the first member or the second member to prevent movement of the first member with respect to the second member at any of the angular positions of the first member with regard to the second member wherein the second member comprises:

a) at least one socket disposed on a base member, and in which the first member is rotatably mounted; and b) a friction pad disposed within the at least one socket and frictionally engaged with the first member.

2. A projectile target comprising:

a) a body portion; and b) a support means including a first member secured directly to the body portion and a second member rotatably affixed directly to the first member opposite the body portion for rotation along a first axis and able to hold the first member at a desired angular position with regard to the second member, wherein the body portion is rotatably secured to the first member opposite the second member along a second axis generally perpendicular to the first axis, further comprising a locking device disposed on one of the first member or the second member and releasably engageable with the other of the first member or the second member to prevent movement of the first member and the body portion with respect to the second member at any of the angular positions of the first member with regard to the second member wherein the body portion is rotatable with respect to the first member and the second member when the locking device is in an engaged position wherein the first member comprises:

i) a horizontal member rotatably engaged with the second member at each end; and ii) a vertical member disposed centrally on the horizontal member and extending perpendicularly outwardly from the horizontal member.

3. The target of claim 2 wherein the support means includes a base portion adapted to be affixed to a support surface.

4. The target of claim 2 wherein the locking device is a clamp.

5. The target of claim 2 further comprising indicia disposed on one of the first member or the second member to indicate a height and distance of the target from an individual being simulated by the position of the first member with regard to the second member.

6. The target of claim 5 wherein the indicia is disposed on the first member and the second member.

7. The target of claim 2 wherein the vertical member is inserted into the body portion.

8. The target of claim 2 wherein the body portion is engaged with an exposed end of the vertical member.

9. The target of claim 2 wherein the body portion simulates at least a portion of the body of an animal.

10. A method for simulating the shooting a projectile at a target from an elevated position while shooting generally horizontally at the target, the method comprising the steps of:

a) providing the target of claim 2;

b) positioning the body portion at a desired angular position relative to the first member;

c) positioning the first member at a desired angular position with respect to the second member; and d) shooting a projectile at the target.

11. The method of claim 10 wherein the step of positioning the first member with respect to the second member comprises aligning indicia representing the simulated distance and height above for the target for the individual that are disposed on the first member and the second member with one another to provide the desired profile for the target.

12. The method of claim 11 further comprising the step of engaging a locking member disposed on one of the first member or the second member with the other of the first member or the second member to maintain the position of the first member with respect to the second member after positioning the first member.

13. The method of claim 12 further comprising the step of disengaging the locking member between the first member and the second member prior to positioning the first member at an angle with respect to the second member.

* * * * *